US012460541B2

(12) United States Patent
Shokanov et al.

(10) Patent No.: US 12,460,541 B2
(45) Date of Patent: Nov. 4, 2025

(54) METHOD OF USING A PERFORATOR DEVICE FOR THE TRANSFER OF NANOPARTICLE TRACER ADDITIVES INTO A FORMATION AND CLUSTER LEVEL FLOW MAPPING

(71) Applicant: QuantumPro, Inc., Houston, TX (US)

(72) Inventors: Talgat Shokanov, Houston, TX (US); John Oliver, Sugar Land, TX (US); Quanxin Guo, Sugar Land, TX (US)

(73) Assignee: QuantumPro, Inc., Houston, TX (US)

( * ) Notice: Subject to any disclaimer, the term of this patent is extended or adjusted under 35 U.S.C. 154(b) by 62 days.

(21) Appl. No.: 18/106,113

(22) Filed: Feb. 6, 2023

(65) Prior Publication Data

US 2024/0263554 A1 Aug. 8, 2024

(51) Int. Cl.

| | |
|---|---|
| ***E21B 43/11*** | (2006.01) |
| ***E21B 43/117*** | (2006.01) |
| ***E21B 47/11*** | (2012.01) |
| ***E21B 49/08*** | (2006.01) |

(52) U.S. Cl.

CPC ..... *E21B 47/11* (2020.05); *E21B 43/117* (2013.01); *E21B 49/08* (2013.01)

(58) Field of Classification Search

CPC ..... E21B 43/117; E21B 49/08

USPC ..... 166/250.12

See application file for complete search history.

(56) References Cited

U.S. PATENT DOCUMENTS

| | | | | |
|---|---|---|---|---|
| 10,613,053 | B2 * | 4/2020 | Al-Gouhi | G01N 27/44769 |
| 2012/0175109 | A1 * | 7/2012 | Richard | E21B 43/11857 166/250.1 |
| 2021/0047903 | A1 * | 2/2021 | Albert | E21B 43/119 |
| 2021/0054733 | A1 * | 2/2021 | Jabari | E21B 33/12 |
| 2022/0381140 | A1 * | 12/2022 | LaGrange | E21B 47/11 |
| 2022/0397376 | A1 | 12/2022 | Chen et al. | |
| 2024/0230288 | A9 | 7/2024 | Chen et al. | |

OTHER PUBLICATIONS

Squires, et al., "Perf Guns, They're Not Just for Holes Anymore! Perf Cluster Tracer Injection", SPE-210134-MS, pp. 1-11, 2022 SPE Annual Technical Conference and Exhibition held in Houston, Texas, USA, Oct. 3-5, 2022.

Squires, et al., "Diagnostic Energetics for Cluster Level Resolution Flowback Profile", IPS Presentation, pp. 1-14, 2022 International Perforating Symposium.

* cited by examiner

*Primary Examiner* — William D Hutton, Jr.

*Assistant Examiner* — Ashish K Varma

(74) *Attorney, Agent, or Firm* — Kearney, McWilliams & Davis, PLLC; John M. DeBoer

(57) ABSTRACT

A method of using a tracer additive in a wellbore that includes using a perforator device, the perforator device having an at least one shaped charge associated with the tracer additive. The method includes deploying the perforator device into the wellbore in manner whereby the perforator device arrives at a desired location, and sufficiently detonating an explosive material of the shaped charge so that the tracer additive comes into contact with a target formation. The tracer additive has a first composition, and is in powder form.

14 Claims, 10 Drawing Sheets

METHOD OF USING A PERFORATOR DEVICE FOR THE TRANSFER OF NANOPARTICLE TRACER ADDITIVES INTO A FORMATION AND CLUSTER LEVEL FLOW MAPPING

BACKGROUND

Field of the Disclosure

This disclosure generally relates to the use of an innovative type of nanoparticle additive known as a 'tracer' in a wellbore or other comparable subterranean formation. The tracer may be disposed into or otherwise associated with a perforator device, which together may then be transferred into the wellbore. Once a shaped charge of the perforator device is detonated, the explosion jet may disperse the tracer into contact with the formation at the perforation level.

The tracer may be flown out from the targeted structure with a resultant produced fluid, then tested in a manner that facilitates determination of flow performance from each individual perforation, or a model of one or more production parameters associated with the wellbore. The disclosure relates to using ultrahigh-resolution inert nano particle tracer technology in oil, gas and geothermal wells that need not necessarily be hydraulically fractured.

Background of the Disclosure

A hydrocarbon-based economy continues to be dominant force in the modern world. As such, locating and producing hydrocarbons, along with understanding the flow performance of subsurface formations, continues to demand attention from the oil and gas (O&G) industry. A well or wellbore is generally drilled in order to recover valuable hydrocarbons and other desirable materials trapped in geological formations in the Earth, which are later refined into commercial products, such as gasoline or natural gas. The wellbore may be cemented, cased, etc. as well understood in the art.

In some instances (such as an unconventional wellbore), the rock formation may require fracturing in order to stimulate the flow: Typically, this is achieved by a two-step process commonly referred to as "plug-and-perf", where the 'perf' refers to a perforation step that requires firing a series of perforation charges (sometimes shaped charges) resulting in perforations through the casing and cement that extend into the formation.

The wellbore may be perforated in a series of sections, with a respective target section or stage isolated by a zone isolation tool. Once perforation is complete, the 'plug' step occurs whereby the isolated section may be subject to injection of high-pressure fluid sufficient enough to cause hydraulic fracturing in the rock.

An example of a known shaped charge design is shown in FIG. 1A. The shaped charge 128 has a charge housing or case 130 having an opening 132 at the charge housing end 134, while generally closed off at a second charge housing end (e.g., in a cylindrical shape) 136. There is then a liner 138 to maintain and hold a charge explosive material 140 (of the type normally to create a high-velocity jet and a shock wave) within the housing 130.

An initiator such as detonator (cord) 142 may be coupled with the charge housing end 136. The charge 128 is oriented in a (radially) outward direction when in use. In operation, the detonator 142 is operable to detonate the explosive material 140, resulting in a high velocity jet of liner material.

The jet breaches the wall of the perforator device (gun), the casing, then the cement, and finally the formation rock, resulting in a hole (or perforation tunnel) that creates a path for either fluid injection or for oil/gas extraction.

FIG. 1B shows an example of a perforator device 144 having multiple charges 128, and in most instances multiple devices 144 are used, corresponding to desired perforation zones, all associated with gun string 119. The perforator device 144 includes a detonator and control circuitry. Once detonated the shaped charge 128 will eject a jet of material to form the aforementioned perforation tunnel into the formation 101.

Once perforating operations are complete, it is desirous to commence production. In conventional wells, this may occur with better frequency. Just the same, no matter the well type, common today to increase or enhance production in the tight or unconventional reservoirs is the use of hydraulic fracturing (i.e., "fracing") in the surrounding formations.

Fracing entails the pumping of fracturing fluids with sand into a formation in an open-hole or via perforations in a cased wellbore or other openings in the casing to form a fracture(s) in the formation. Fracing routinely requires very high fluid pressure and pumping rate and can occur in a multi-stage fracing manner.

The modern design of shale well with multi-stage hydraulic fracturing operations involve pumping from 20 to 100 fracing stages and from 1 to 10 or more perforation clusters per stage with a cumulative volume of 5 to 20 million gallons of water and from 5 to 20 million pounds of sand per well. This represents a total cost ranging from 4.0 million to 9.5 million U.S. dollars per well. Fracing operations are expensive, increasingly environmentally challenging and emissions intensive, and can represent up to 70% of the total cost for each well.

With such extensive costs, there may be situations where a wellbore is not subjected to hydraulic fracturing, but yet it still might be desirous to have some amount of diagnostic information about the well. For example, producers may desire to know when production occurs from a target formation. For the sake of flow assurance, it might be desirous to have diagnostic information that may be decoupled from fracturing. It follows that it might be desirous to have diagnostic information about (a part of) the wellbore, but not necessarily a fractured area.

Production diagnostic tools may be used in order to predict well performance, improve well design, or aid in future well development. Typically, diagnostic or surveillance tools include PLT (production logging), fiber-optic, and liquid chemical tracers.

Use of fiber optic systems that include distributed acoustic sensing (DAS) and distributed temperature surveys (DTS) is known to provide high-end diagnostic results. However, fiber is known to be excessive in cost and deployment complexities, and the time to obtain useful data may be in the realm of weeks or longer. Depending on the complexity, the installation of fiber optic DAS and DTS systems can add as much as $1 million/well to the completed total costs.

PLT also has its favored uses and is a historically well accepted approach, but while perhaps slightly lower in cost, it is known to provide a short snapshot view and information compared to fiber and requires well shut-in and costly wireline intervention.

Conventional chemical liquid tracers have enjoyed success but are also known to have limitations. These tracers are dissolvable in oil and water phases, and typically have fluorescent properties, DNA and ionic, organic materials, or radioactive diagnostic isotopes. Such tracers are used to evaluate fracturing performance, ostensibly to control the effectiveness of multi-stage hydraulic fracturing stimulation. Owing to obvious environmental deficiencies, tracers incorporating radioactive isotopes have largely fallen out of favor. Given their soluble characteristics, conventional chemical tracers must be tailored for individual fluid types, thereby requiring more, and often exotic, formulations for a single stage, increasing the chemical tracer costs appreciably.

Each of the aforementioned techniques: fiber, PLT, and liquid chemical tracer tools also have temperature limitations (i.e., for use in <500° F.) that make their use problematic at best in unconventional or igneous geothermal reservoirs, where temperatures may be as high as 1,000° F. Moreover, these techniques are routinely coupled with the frac operation, and usually used for stages.

The industry needs a simplistic, low-cost diagnostic method that can be used for assessing reservoir quality, completion design, and other wellbore performance parameters, especially for target areas of the formation (such as the wellbore bottom or toe) that need not be related to a particular perforation cluster and 'stage'. This is especially the case for the instance when the diagnostic can be decoupled from a fracturing operation, as such operations require additional steps, equipment, interventions, etc.

The need for an ultrahigh resolution nanoparticle tracer that is versatile, affordable, highly accurate, non-radioactive, non-intrusive and quick to test is increasing as never before for all applications. What is needed is a new and improved way of forming and using a fast, cost-favorable, effective, and reliable way of evaluating a wellbore.

SUMMARY

Embodiments of the disclosure pertain to a method of using a tracer additive in a wellbore that may include one or more steps described herein. The method may include using a shaped charge having a tracer additive associated therewith at the time of deployment.

Embodiments pertain to a shaped charge having a tracer additive, the shaped charge may further include: a first charge housing end: a second housing end; and an inner cavity. There may be an explosive material disposed within the inner cavity. In aspects, the shaped charge may be configured to detonate upon activation of a signal and form or cause a resultant explosive material jet stream. The tracer additive may be associated or otherwise disposed in a manner with the shaped charge housing in a way whereby the explosive material jet stream comes into contact with at least some of the tracer additive.

There may be a liner is disposed in shaped charge in a manner to maintain the explosive material therein. In aspects, the tracer additive may be disposed or deposited within the liner. This may occur at the time the liner is formed. In other aspects, the tracer additive may be mixed within the explosive material. The tracer additive present in the liner may include no more than 10% (by weight) of the liner.

The shaped charge may include an insert coupled with the first charge housing end. The tracer additive may be mixed with a substrate. The resultant mix may be packed into the insert. The insert may be made of a durable material such as metal. The insert may include a ring shape. In aspects, the substrate may be hydrocarbonaceous, such as an oily substance.

The tracer additive may have a first tracer composition, which may be unique as compared to any other tracer additives. When added to the shaped charge or to a component of the shaped charged, the tracer additive may be in a solid powder form. The tracer additive may have an average particle diameter of at least 0.01 μm to no more than 10 μm. The tracer additive may have an average bulk specific gravity of at least 0.6 g/cm$^3$ to no more than 1.6 g/cm3.

The tracer additive or another tracer additive may be mixed with the explosive material to form an explosive material mixture. The explosive material mixture may include no more than 10% (by weight) of any tracer additive.

If the shaped charge or another shaped charge includes another tracer additive (such as a second tracer additive), that additive may be unique and have its respective tracer composition. The second tracer may have a solid powder having an average particle diameter of at least 0.01 μm to no more than 10 μm. The second tracer additive may have an average bulk specific gravity of at least 0.6 g/cm$^3$ to no more than 1.6 g/cm3.

The tracer additive may be disposed in at least one of: the explosive material, the liner, the insert, and combinations thereof.

A system for introducing a tracer additive into a target formation that may include: a work string disposed into a wellbore: a perforator device operably connected with the work string, the perforator device having an at least one shaped charge disposed thereon.

The shaped charge may include a shaped charge housing comprising: a first charge housing end: a second housing end; and an inner cavity. There may be an explosive material disposed within the inner cavity.

The shaped charge may be configured to detonate upon activation of a signal and form an explosive material jet stream. The tracer additive may be associated with the shaped charge housing in a way whereby the resultant explosive material jet stream comes into at least partial contact with the tracer additive.

A liner may be disposed in the inner cavity in a manner to maintain the explosive material therein. The tracer additive may be disposed within the liner. The tracer additive may be mixed within the explosive material. In aspects, the shaped charge may include an insert coupled with the first charge housing end. The tracer additive may be packed into the insert. The tracer additive may be mixed with a substrate, which may be hydrocarbonaceous.

Accordingly, the tracer additive may be disposed in at least one of: the explosive material, the liner, the insert, and combinations thereof.

The insert may be placed proximately to the charge, such as in front of the charge, next to the charge, or on the side, etc. or any other position/location (e.g., in the charge loading tube).

Yet other embodiments of the disclosure pertain to a method of using a tracer additive such as in a wellbore. The method may include using a perforator device configured with an at least one shaped charge disposed thereon. There may be a tracer additive associated with (such as disposed in or on) the at least one shaped charge.

The method may include sending the perforator device into the wellbore in manner whereby the perforator device arrives at a target formation in communication with the wellbore. Then, detonating the at least one shaped charge so that the tracer additive via an explosive jet stream discharged from the shaped charge is carried into contact with the target formation. Upon contacting the target formation with the tracer additive for an amount of time, returning a remnant fluid that includes at least a portion of the tracer additive to a surface.

In aspects, the tracer additive may have a first tracer composition. The tracer additive may be in a solid powder form having an average particle diameter of at least 0.01 μm to no more than 10 μm. The tracer additive may have an average bulk specific gravity of at least 0.6 g/cm$^3$ to no more than 1.6 g/cm3.

The method may include taking a sample of the remnant fluid, and testing the sample in order to analyze the remnant fluid in order to provide a set of fluid data. Then, integrating the set of fluid data with other wellbore data in order to determine a parameter associated with performance of the wellbore.

The shaped charge may have a liner disposed in the inner cavity in a manner to maintain the explosive material therein. The shaped charge may include an insert. The tracer additive may be disposed in at least one of: the explosive material, the liner, the insert, and combinations thereof.

The method may include use of a second charge associated with a second tracer additive. After detonation of the shaped charge, the second tracer additive may come into contact with the respective target formation.

The second tracer additive may have a different composition from the tracer additive. The second tracer additive may be in powder form. The second tracer additive may have an average particle diameter, such as of at least 0.01 μm to no more than 10 μm. The second tracer additive may have an average bulk specific gravity, such as of at least 0.6 g/cm$^3$ to no more than 1.6 g/cm3.

In aspects, the testing the sample step may include using a fluorescence response-based analysis. For example, the fluorescence response-based analysis may include use of EDXRF.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below; and the accompanying drawings, which are given by way of illustration only and are not intended to be limitative of the present embodiments, and wherein.

DETAILED DESCRIPTION

Figure 1A:
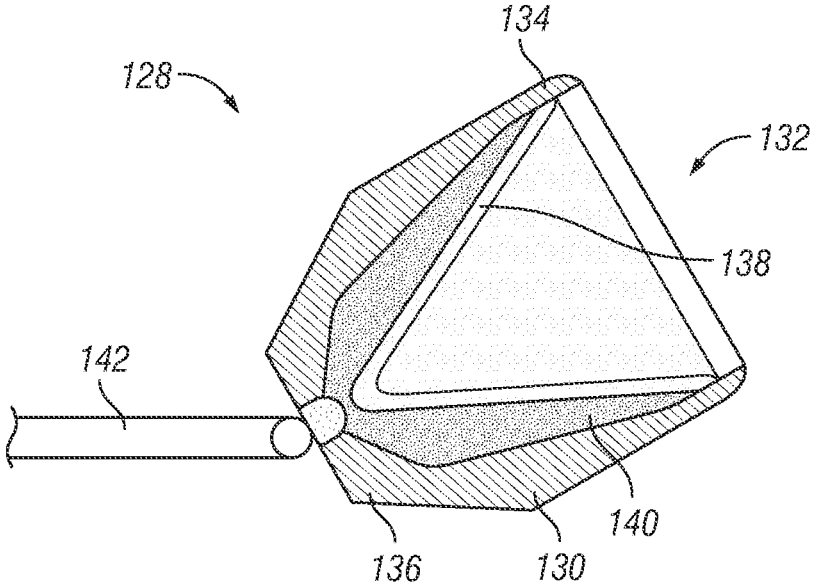
FIG. 1A (Prior Art)
FIG. 1A shows a side view of a conventional shaped charge.
Figure 1B:
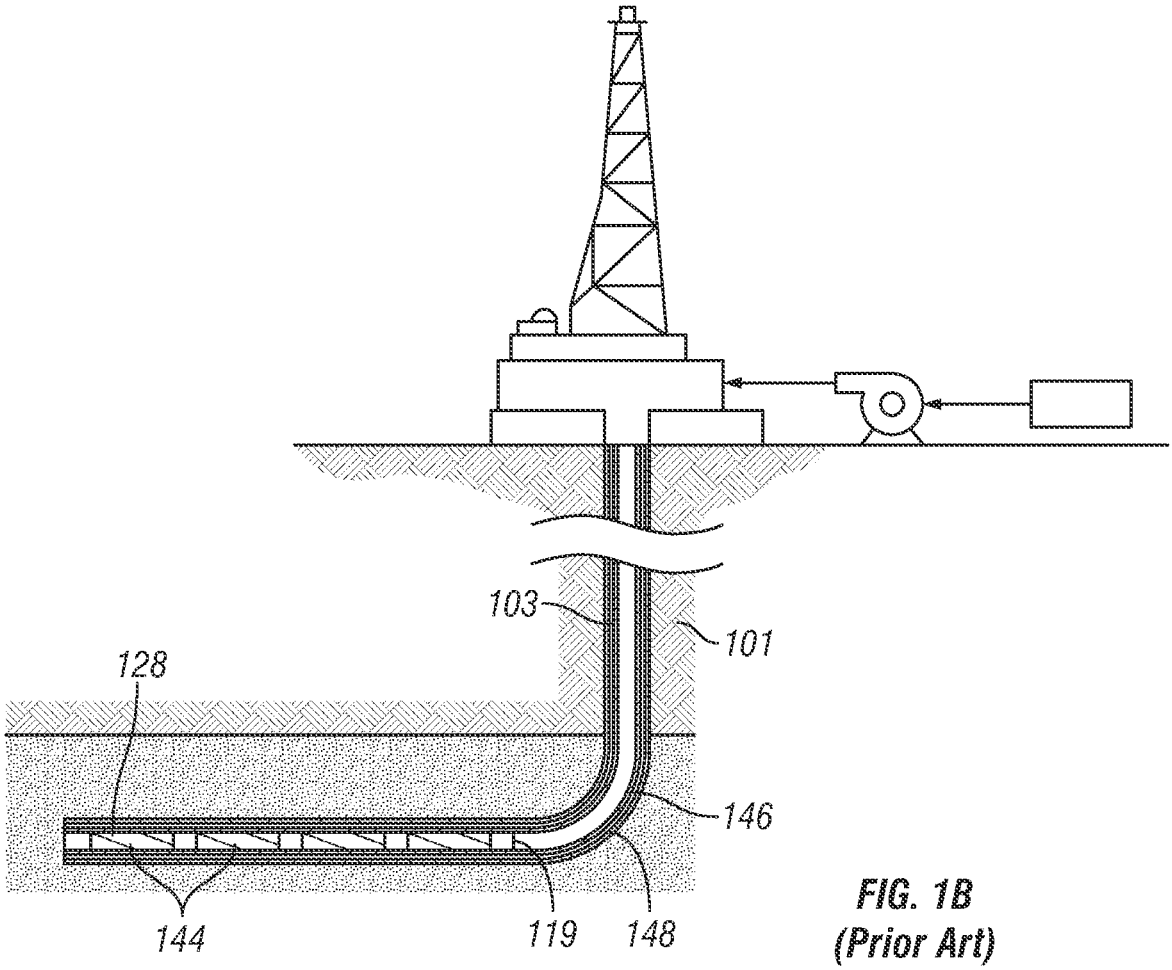
FIG. 1B (Prior Art)
FIG. 1B shows a simplified schematic view of conventional gunstring disposed in a wellbore.

Regardless of whether presently claimed herein or in another application related to or from this application, herein disclosed are novel apparatuses, units, systems, and methods that pertain to use of solid inert tracer additives, details of which are described herein. Embodiments of the disclosure may refer to "in-wellbore tracer deployment"—where the tracer is already in the wellbore (associated with a shaped charge of perforator device) before deployment of the tracer into the wellbore occurs (akin to "in-charge tracer deployment" or "in-gun tracer deployment").

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure: however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new; used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw; nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, single phase, multi-phase, pure, impure, etc. and is not limited to any particular type of fluid such as hydrocarbons.

The term "utility fluid" as used herein may refer to a fluid used in connection with any fluid disposed into a wellbore (akin to an injection fluid). The utility fluid may be pressurized, and may be used to carry an additive into the wellbore. 'Utility fluid' may also be referred to and interchangeable with 'service fluid' or comparable.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "tubestring" or the like (such as 'workstring') as used herein may refer to a tubular (or other shape) that may be run into a wellbore. The tubestring may be casing, a liner, production tubing, combinations, and so forth. The tubestring may be multiple pipes (and the like) coupled together. The tubestring may be used for transfer of fluids, or used with some other kind of action, such as drilling, running a tool, or any other kind of downhole action, and combinations thereof. The tubestring may be or include a gun string, which may be one or more perforating gun devices coupled together.

The term "composition" or "composition of matter" as used herein may refer to one or more ingredients, components, constituents, etc. that make up a material (or material of construction). Composition may refer to a flow stream of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in "water". A chemical may include all isomeric forms and vice versa (for example, "hexane", includes all isomers of hexane individually or collectively).

The term "explosive material" as used herein may refer a material with a composition of matter having properties and/or characteristics that, upon an igniting or detonation, results in an explosion that creates a jet of material. The direction of the jet of material may be controlled or otherwise predicted.

The term "liner" as used herein may refer to a solid object formed from pressed powder (under high pressure). Tracer additives may be mixed with a liner powder forming a liner mixture powder. This may be before the mixture is pressed (e.g., using a liner punch into a liner diebody to make a liner).

The term "water" as used herein may refer to a pure, substantially pure, and impure water-based stream, and may include wastewater, process water, fresh water, seawater, produced water, slop water, treated variations thereof, mixes thereof, etc., and may further include impurities, dissolved solids, ions, salts, minerals, and so forth. Water for a frac fluid can also be referred to as "frac water".

The term "impurity" as used herein may refer to an undesired component, contaminant, etc. of a composition. For example, a mineral or an organic compound may be an impurity of a water stream.

The term "frac fluid" as used herein may refer to a fluid injected into a well as part of a frac operation. Frac fluid is often characterized as being largely water, but with other constituents such as proppant, friction reducers, and other additives or compounds.

The term "produced fluid", "production fluid", and the like as used herein may refer to water, gas, mixtures, and the like recovered from a subterranean formation or other area near the wellbore. Produced fluid may include hydrocarbons or aqueous, such as flowback water, brine, salt water, or formation water. Produced water may include water having dissolved and/or free organic materials. Produced fluid may be akin to 'wellbore fluid', in that the fluid may be returned from the wellbore. Produced fluid may include utility fluids and formation fluids.

The term "frac operation" as used herein may refer to fractionation of a downhole well that has already been drilled. 'Frac operation' can also be referred to and interchangeable with the terms fractionation, hydraulic fracturing, well stimulation, production enhancement, hydrofracturing, hydrofracking, fracking, fracing, and frac. A frac operation can be land or water based. Generally, the term 'fracing' or 'frac' is used herein, but meant to be inclusive to other related terms of industry art.

The phrase "processing a fluid" as used herein may refer to some kind of active step or action, such as man-made or by machine, imparted on the fluid (or fluids). For example, a fluid may be received into a device (such as a mixer) and upon processing, may leave as a 'processed fluid'. 'Processed' is not meant be limited, as this may include reference to transferred, treated, tested, measured, mixed, sensed, separated, combinations, etc. in whatever manner may be desired or applicable for embodiments herein. It is noted that while various steps or operations of any embodiment herein may be described in a sequential manner, such steps or operations may be operated in batch or continuous fashion.

The term "tracer" as used herein may refer to an identifiable substance, such as a liquid dye, liquid chemical or a particles powder, which may be followed through the course of a mechanical, chemical, or biological process. In the present disclosure, a tracer may be used in a well, and the resultant process impact on the tracer evaluated. In this respect, the tracer may help evaluate, determine, and otherwise model well production and performance. The tracer may be added (and thus may be referred to as a 'tracer additive' or 'additive') to a shaped charge that is run into the well (via a workstring).

The term "nanoparticle" as used herein may refer to a small particle that ranges between 1 to 1000 nanometers in size diameter, and is undetectable by the human eye. A tracer in powder form may be nanoparticles. A tracer additive of the present disclosure may be in powder form with an average bulk diameter in a range of about 0.01 μm to about 10 μm.

The term "EDXRF" (Non-destructive Energy Dispersive X-Ray Fluorescence) as used herein may refer to a type of spectroscopy process (and may thus include use of a spectrometer) where a sample of material (such as a portion of produced fluid) is 'excited' in order to collect emitted fluorescence radiation, which may then be evaluated for different energies of the characteristic radiation from each of the different constituents (or elements) in the sample. The EDXRF process may be referred to as a fluorescence response-based analytical process.

EDXRF may be considered a non-destructive analytical technique used to determine the elemental composition of materials. EDXRF analyzers determine the elemental composition of a sample by measuring the fluorescent (or secondary detectable energy) X-ray emitted from a sample when it is excited by a primary X-ray source. EDXRF is designed to analyze groups of elements simultaneously to determine those elements presence in the sample and their relative concentrations—in other words, the elemental composition of the sample.

Each of the elements present in a sample produces a unique set of characteristic X-rays that is a "fingerprint" for that specific element. X-rays have a very short wavelength, which corresponds to very high energy. All atoms have several electron orbitals (K shell, L shell, M shell, for example). When X-ray energy causes electrons to transfer in and out of these shell levels, X-ray fluorescence peaks with varying intensities are created and will be present in the spectrum. The peak energy identifies the element, and the peak height or intensity is indicative of its concentration.

The term "XRD" may refer to X-ray diffraction, which is a technique for analyzing the atomic or molecular structure of materials. It is non-destructive, and works most effectively with materials that are wholly, or part, crystalline. The technique is often known as x-ray powder diffraction because the material being analyzed typically is a finely ground down to a uniform state. Diffraction is when light bends slightly as it passes around the edge of an object or encounters an obstacle or aperture. The degree to which it occurs depends on the relative size of a wavelength compared to the dimensions of the obstacle or aperture it encounters.

All diffraction methods start with the emission of x-rays from a cathode tube or rotating target, which is then focused at a sample. By collecting the diffracted x-rays, the sample's structure can be analyzed. This is possible because each mineral has a unique set of d-spacings. D-spacings are the distances between planes of atoms, which cause diffraction peaks.

Figure 2A:
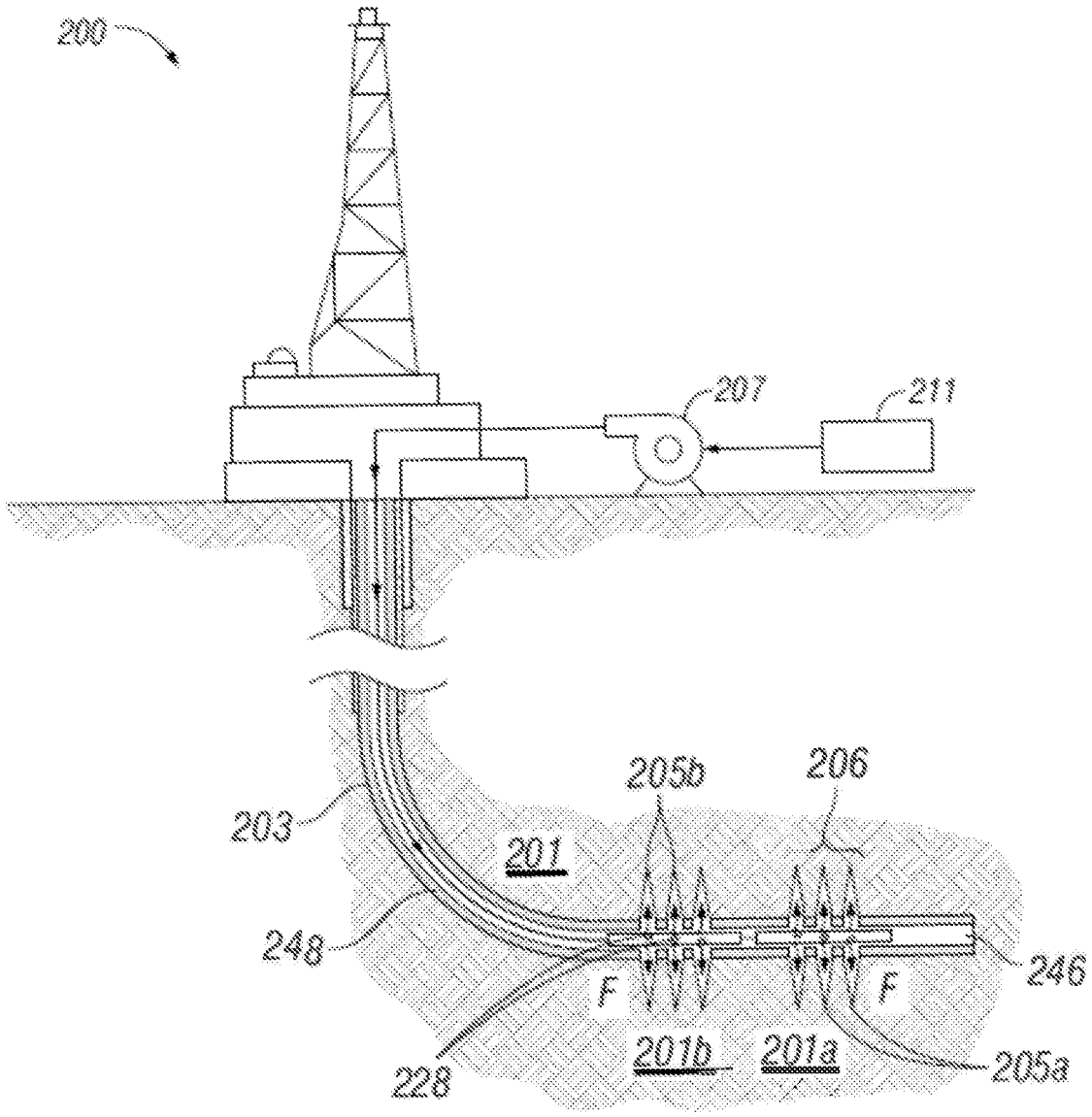
FIG. 2A shows a side view of a system for using a perforator device for the transfer of a tracer additive into a wellbore according to embodiments of the disclosure.
Figure 2B:
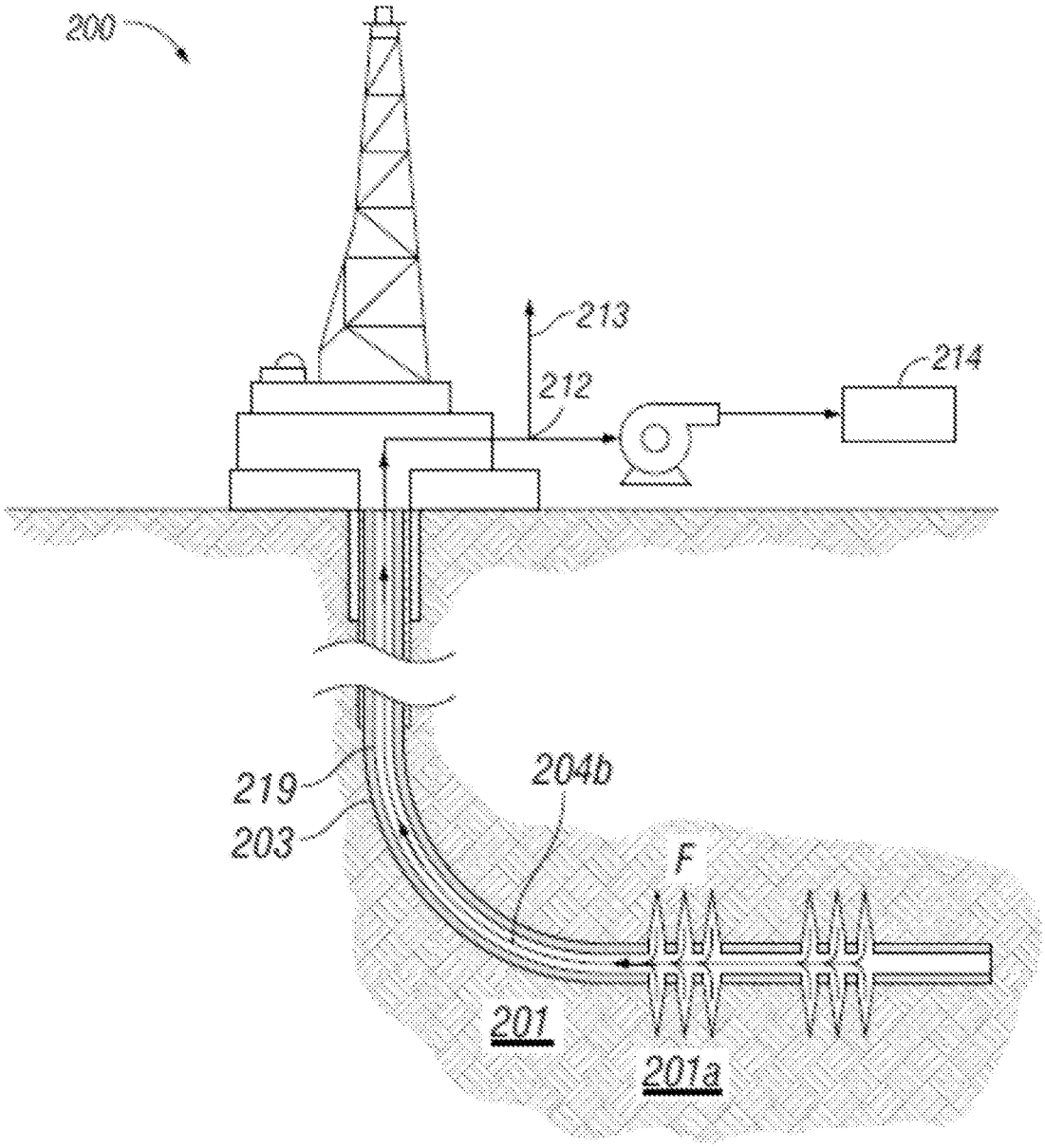
FIG. 2B is a side view of a system where a remnant fluid with a tracer additive is produced from a wellbore according to embodiments of the disclosure.
Figure 2C:
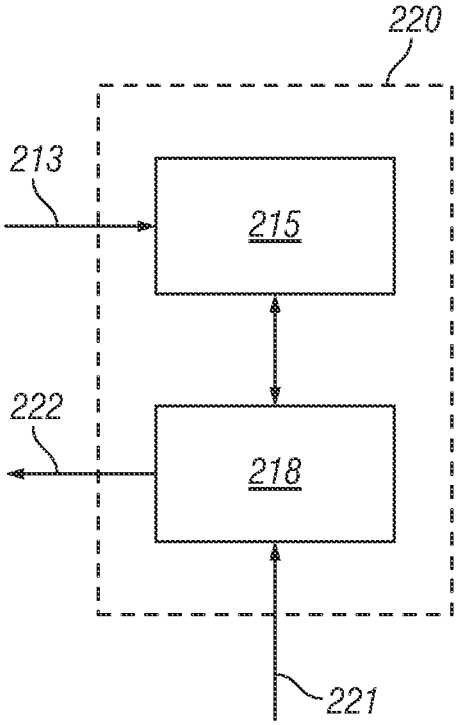
FIG. 2C is a simplified block diagram of an analytical unit used to test a sample having a tracer additive according to embodiments of the disclosure.

Referring now to FIGS. 2A, 2B, and 2C, together, a side view of a system for using a perforator device for the transfer of a tracer additive into a wellbore, side view of a system where a remnant fluid with a tracer additive is produced from a wellbore, and a simplified block diagram of an analytical unit used to test a sample having a tracer additive, respectively, according to embodiments disclosed herein, are shown.

The system 200 may include one or more components (or subcomponents) coupled with new; existing, or retrofitted equipment. System 200 may include one or more units that are skid mounted or may be a collection of skid units, and the system 200 may be suitable for onshore and offshore environments.

FIGS. 2A-2C are meant to show in a simplistic manner embodiments herein, and may not be to scale. The system 200 may have various valves, flanges, pipes, pumps, utilities, monitors, sensors, controllers, flow meters, safety devices, etc., for accommodating sufficient universal coupling between system components and any applicable feedline/feed source of a material to be processed, any resultant product material to be discharged or transferred therefrom, and anything in between.

The system 200 may include a subterranean or earthen formation 201 having a wellbore 203 drilled or otherwise formed therein. The formation 201 may contain hydrocarbonaceous fluids, such as oil, natural gas, and/or other materials, generally designated as F. The formation 201 may include porous and permeable rock containing liquid and/or gaseous hydrocarbons. The formation may include a conventional reservoir, an unconventional reservoir, a tight gas reservoir, and/or other types of reservoirs, which may include those with multi-stage fracking, multi-lateral wells, horizontal wells, injectors and acidizing, etc.

The wellbore 203 may have a casing (casing string, etc.) 246 disposed therein, which may be held in place or otherwise secured via cement 248. There may be a workstring 219 configured with one or more perforator devices 244. When it is desired to perforate the formation 201 (or, e.g., a target formation 201*a*), the workstring 219 may be lowered through casing 246 until the devices 244 are properly positioned relative to the formation 201/target formation 201*a*. There may be a plurality of target formations (or stages) 201*a*, 201*b*, etc.

One or more shaped charges 228 of respective device(s) 244 may be sequentially fired, either in an uphole to downhole or a downhole to uphole direction, or as desired. Upon detonation, the shaped charges 228 may form explosive material jets sufficient create perforations 206 extending outwardly through casing 246, cement 248 and into the formation 201, thereby allow formation communication between the formation 201 and the wellbore 203.

In the embodiments shown here, the wellbore 203 may have a generally vertical portion and a lower horizontal portion: however, as one of skill would appreciate the workstring 219 and perforator devices 244 of the disclosure may be used in other wellbore environments, such as horizontal, vertical, slant, curved, directional-drilled, geothermal, and/or other well geometries, and combinations.

The first target formation 201*a* may be a stage or zone. Optionally the target formation 201*a* may be part of or associated with a fracing operation. For example, there may be one or more (high pressure) injection pumps 207 configured to inject a fluid, slurry, etc. from source 211 into the formation 201*a*. Just the same, the target formation 201*a* may just be part of the formation 201 without the need for enhanced oil recovery (EOR) or other type of treatment.

Figure 3A:
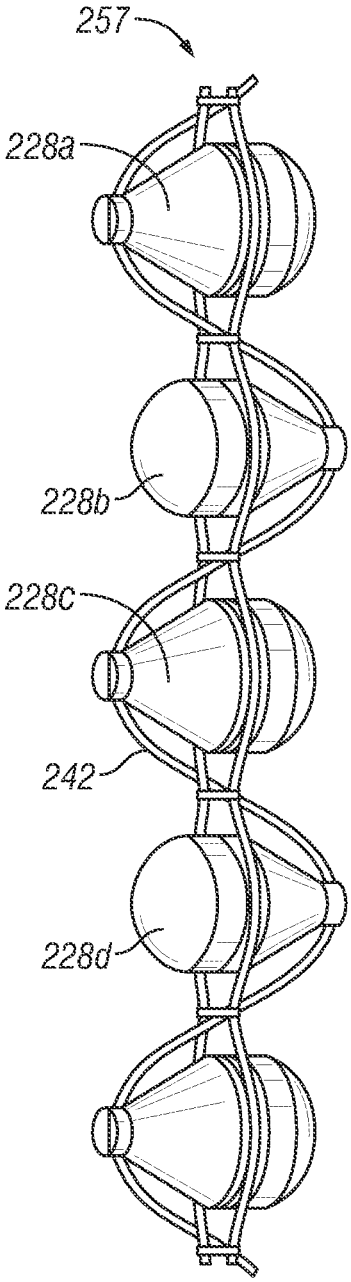
FIG. 3A shows an up-close side view of a plurality of shaped charges for use with a perforator device according to embodiments of the disclosure.
Figure 3C:
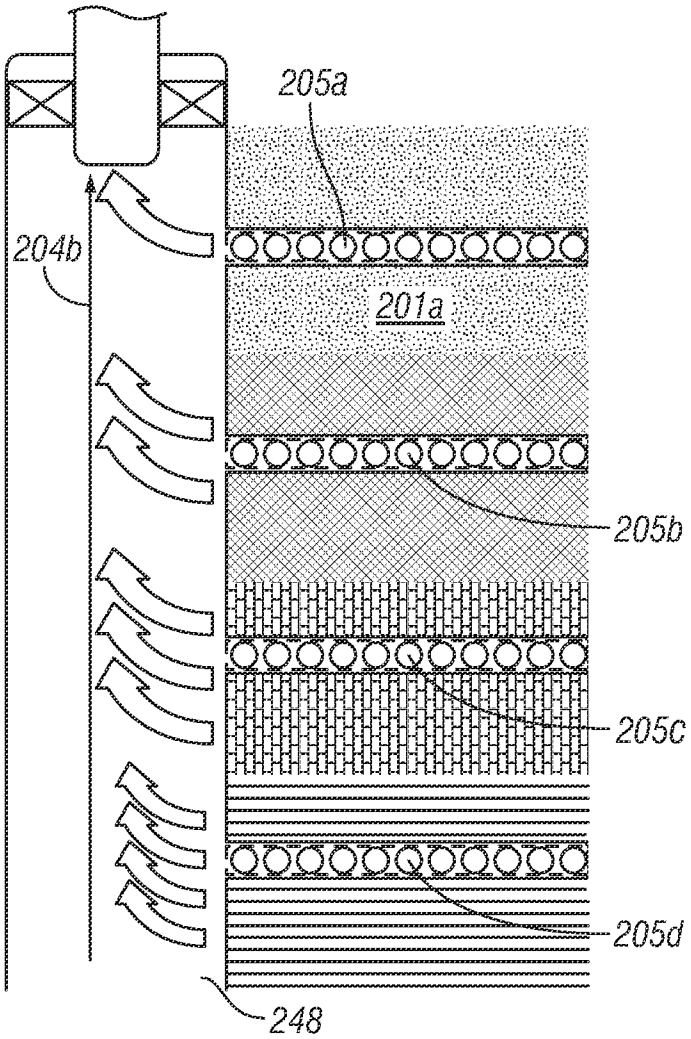
FIG. 3C is a side view of a system where a stage with a respective a tracer additive is produced from a wellbore according to embodiments of the disclosure.
Figure 3B:
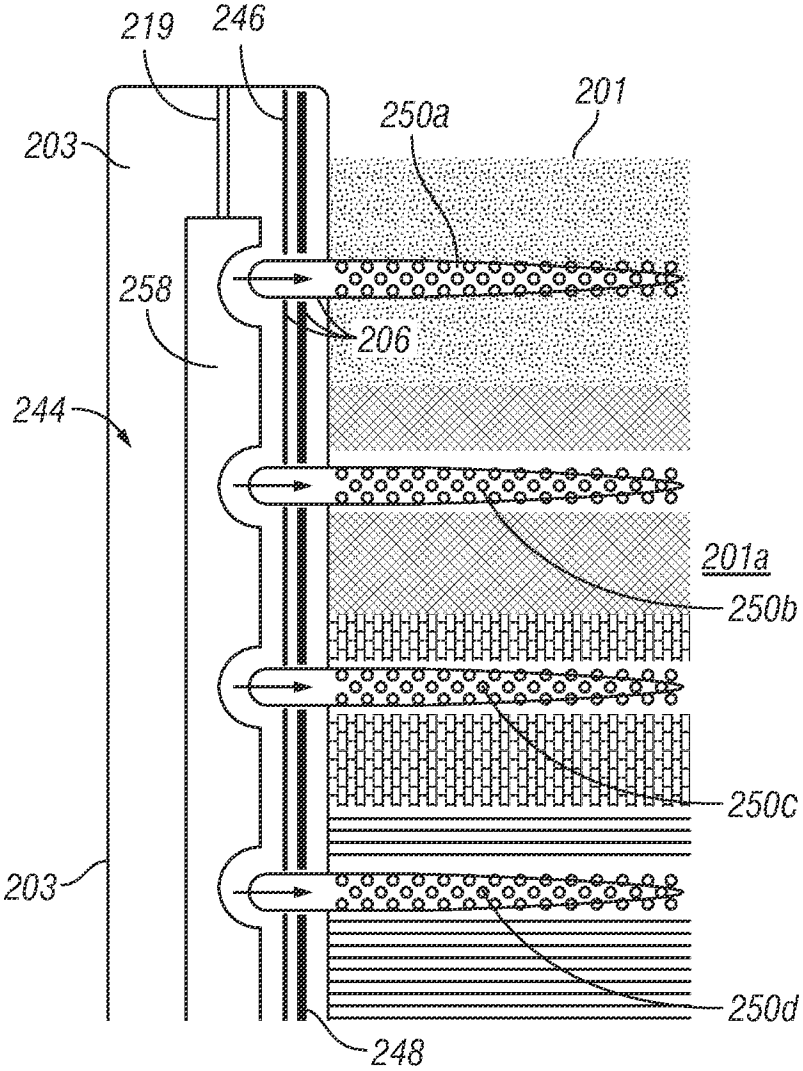
FIG. 3B shows an up-close side view of part of a perforator device with the plurality of shaped charges of FIG. 3A being detonated according to embodiments of the disclosure.

Referring briefly to FIGS. 3A, 3B, 3C, and 3D, an up-close side view of a plurality of shaped charges for use with a perforator device, an up-close side view of part of a perforator device with the plurality of shaped charges, a side view of a system where a stage with a respective a tracer additive is produced from the wellbore, and data analysis and diagnostic information of the stage with respective tracer additive of FIG. 3C, according to embodiments disclosed herein, are shown.

FIGS. 3A, 3B, 3C, and 3D together show a workstring (gunstring) 219 may be conveyed or otherwise run into the wellbore 203. The workstring 219 may have one or more perforator devices 244 operably coupled therewith. The perforator device 244 may be configured with one or shaped charges 228*a*, 228*b*, 228*c*, 228*d*, etc. disposed on a charge tube or carrier 257. The carrier 257 may then be installed or otherwise disposed within the charge tube housing 258.

Embodiments need not be limited, and any number of shaped charges 228 may be used as in order to create desired perforations 206 in the casing 246, cement 248, and the target formation 201*a*. In a similar manner, the shaped charges 228 may be oriented in any direction to facilitate optimal or desired trajectory of the explosive material jet(s) 250*a*, 250*b*, 250*c*, 250*d*, etc. An ignitor signal may be conveyed to the shaped charges 228, such as via a detonator cord 242. The ignitor signal may be controlled via surface equipment (not viewable here) in operable signal communication with the detonator cord 242. While not viewable here, there may be a primer material used within the shaped charge 228.

Each of the shaped charges 228 *a, b, c, d* may have a respective tracer additive 205 *a, b, c, d* associated therewith. As such, each jet may convey a different tracer additive into the formation 201*a*. Just the same, each shaped charge 228 *a, b, c, d* etc. may have multiple different types of tracer additives associated therewith. For example, the shaped charge 228*a* may have a first tracer additive, a second tracer additive, a third tracer additive, etc. associated therewith.

Figure 3D:
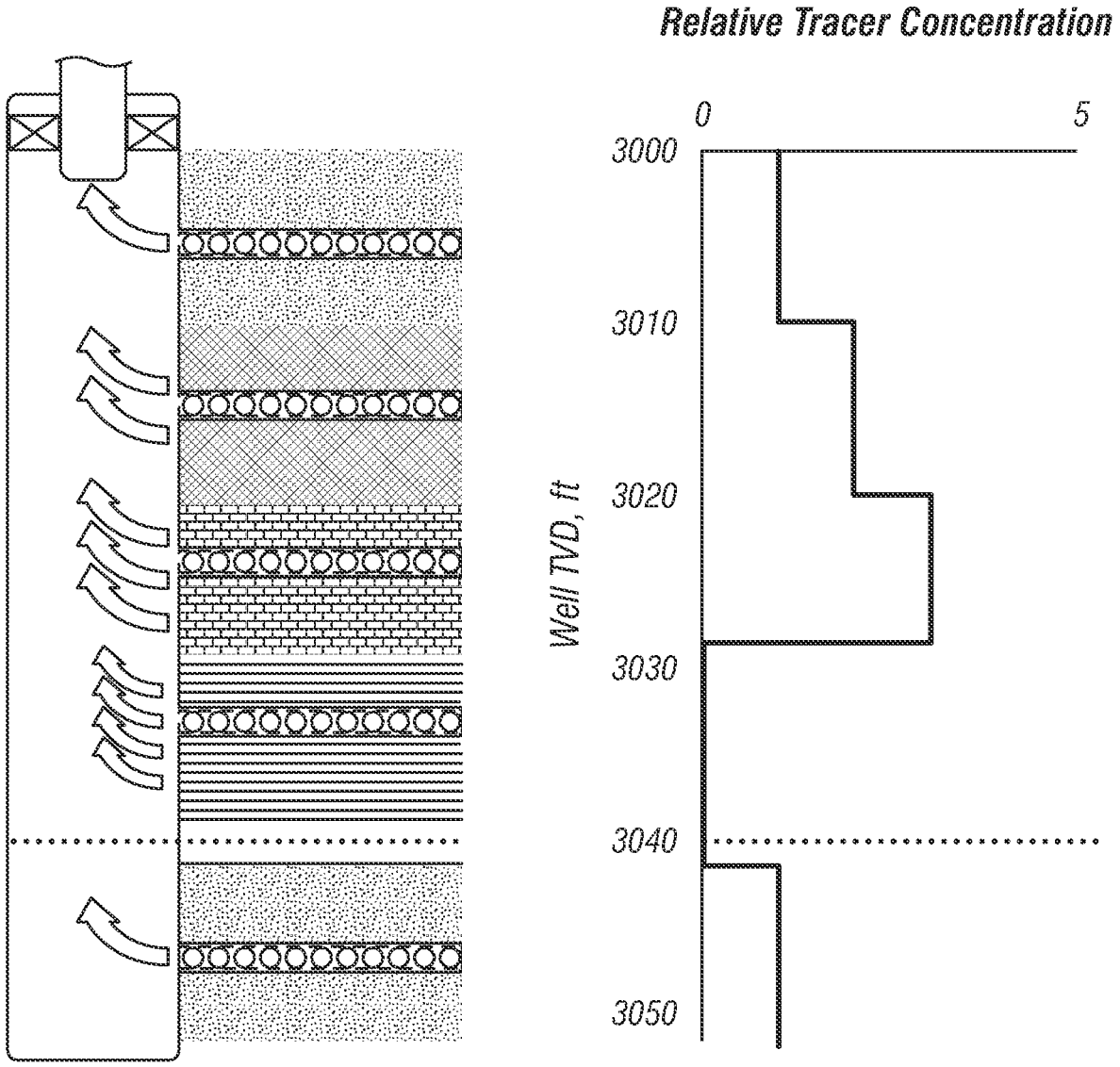
FIG. 3D shows data analysis and diagnostic information of stages with respective tracer additive of FIG. 3C according to embodiments of the disclosure.

FIG. 3D shows diagnostic information about the performance of the wellbore 203, or particular area such as by the target formation 201*a*, may be determined by utilizing the tracer additives. The first tracer additive 205*a* (or other tracer additives described herein) may be of a suitable material for use with any type of formation 201. The first tracer (or any tracer) additive 205*a* may have a (predetermined) first composition, which results in characteristics (or traits) suitable for use in the event the formation 201 has conditions normally undesirable for the use of tracers, namely, liquid tracers.

As a first characteristic, the first tracer 205*a* may be a solid tracer in the form of a powder. The use of powder form makes the first tracer 205*a* attractive for use in high temperature conditions. The first tracer 205*a* may comprise powder nanoparticles. In embodiments, the particles of the first tracer 205*a* may have an average particle diameter of about 0.1 μm to about 10 μm. The first tracer 205*a* may have a first tracer specific gravity. In embodiments, the first tracer 205*a* may have an average bulk specific gravity of about 0.6 g/cm$^3$ to about 1.6 g/cm3. Other or additional tracers 205 *b, c, d* may be like that of the first tracer 205*a*.

Referring briefly to FIGS. 4A, 4B, 4C, 4D, and 4E, a component view of an insert for use with a shaped charge, a downward view of insert with packed a tracer additive and substrate, a side cross-sectional view shaped charge having an insert coupled therewith, a side cross-sectional view of a shaped charge having a plurality of tracer additives disposed therein, and a side cross-sectional view of a shaped charge proximate an insert, respectively, according to embodiments disclosed herein, are shown.

Figure 4A:
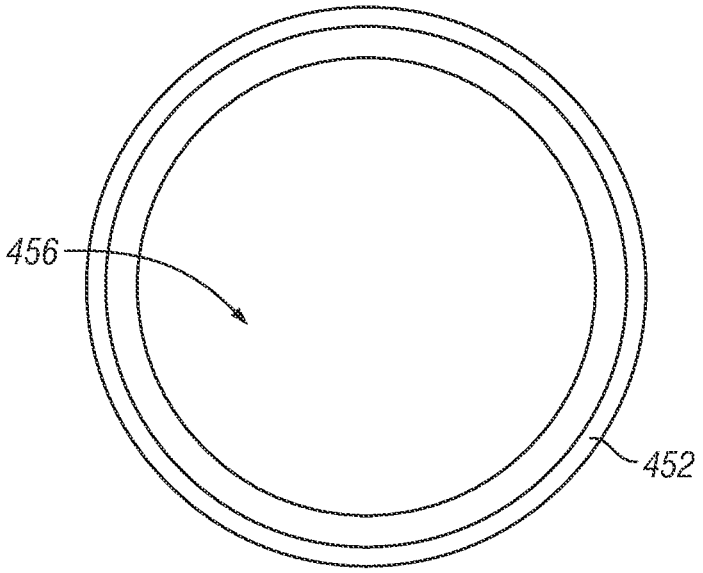
FIG. 4A shows a component view of an insert for use with a shaped charge according to embodiments of the disclosure.
Figure 4B:
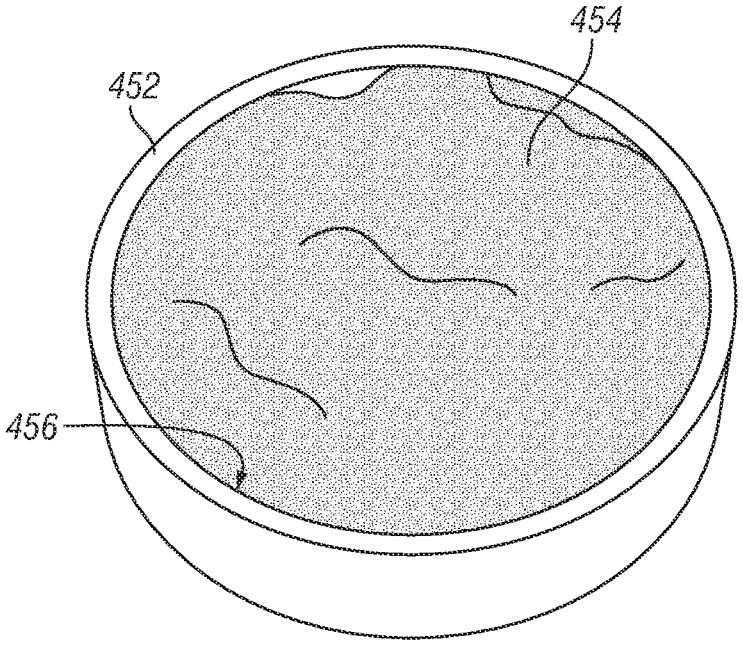
FIG. 4B shows a downward view of the insert of FIG. 4A packed a tracer additive and substrate according to embodiments of the disclosure.
Figure 4C:
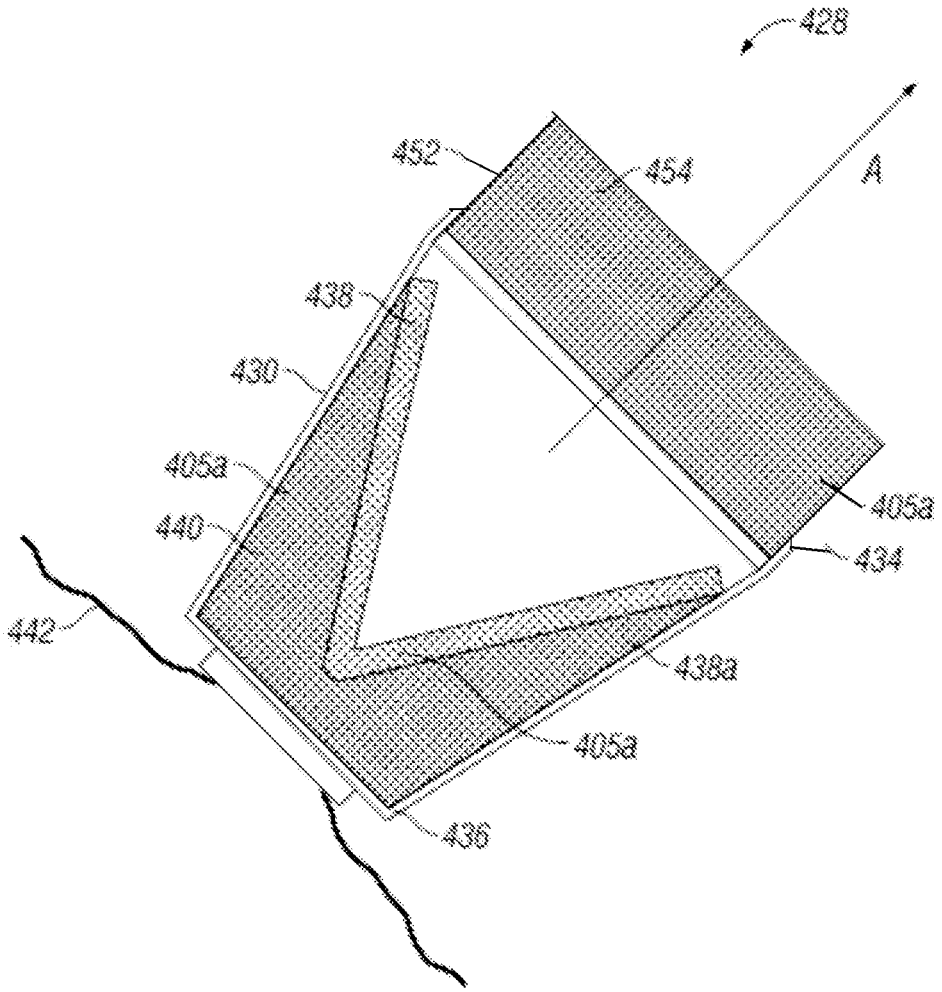
FIG. 4C shows a side cross-sectional view of a shaped charge having an insert coupled therewith according to embodiments of the disclosure.

FIGS. 4A-4C together, show a shaped charge 428 usable with embodiments of the disclosure. The shaped charge 428 may have a charge body or housing 430, which may be configured or otherwise coupled with an insert 452. When desired to be used, the insert 452 may be coupled with the charge body 430 via press-fit or other type of securement, or may simply be placed adjacent thereto. Although not shown here, other configurations of securement may include threads, adhesion, or being integral thereto. The insert 452 may be disposed or otherwise coupled with or proximate to a first housing end 434.

The insert 452 need not be limited to any particular shape or configuration: as shown here the insert 452 may be ring- or disc-shape and made of a durable material (such as metal) with an opening on either end accessible to an inner insert hollow 456. The tracer additive 405*a* may be readily packed into the hollow 456 of the insert 452. The packed additive 405*a* may include a liquidous substrate (such as oil or other useful hydrocarbonaceous material) resulting in an additive mixture 454. In the event the insert 452 is used, the position is not limited. For example, the insert 452 may be placed proximately to the charge 428, such as in front of, next to, or on the side, or any other position/location (in the charge loading tube).

The shaped charge 428 may have a liner 438 configured to hold an explosive material 440 therein. As illustrated by FIG. 4C, the explosive material 440 may be mixed with the tracer additive 405*a* or another tracer additive (such as a second tracer additive—see FIG. 4D). One of skill would appreciate that the particle size of the tracer additive 405*a* as shown here is not to scale: the depiction is exaggerated in order to illustrate the additive 405*a* may be distributed or mixed into the explosive material 440, the mixture 454, and/or the liner 438.

So that the performance of the explosive material 440 in forming the perforation is unaffected, the amount of tracer additive 405*a* may be limited, such as about less than 10% (e.g., by weight) of the total explosive-additive mixture disposed within a cavity 438*a* under the liner 438.

The shaped charged 428 may be configured to facilitate detonation of the explosive material 440, which may then collapse the liner 438. This thereby creates or results in a high velocity jet of material (e.g., 250*a*, 250*b*, etc.) that is capable of penetrating surrounding structure(s).

The liner 438 may be formed from a durable material, such as metal or metal alloy. This material of the liner 438 may first be formed into a powder, and then (die) pressed into a desired shape (such as conical) corresponding to the body 430 of the shaped charge 428 or material 440). At least a portion of the tracer additive 405*a* may be mixed with the liner powder forming a liner powder mixture. The amount of the tracer additive 405*a* used may be about less than 10% (e.g., by weight) of the total liner powder mixture.

A detonator (primacord or the like) 442 may be coupled with the housing 430 at a second housing end 436. Upon detonation, an explosive material jet (e.g., 250*a*) may discharge from the shaped charge 428 in the direction of arrow A, thereby coming into contact with the tracer additive 405*a*. At least a portion of the tracer additive 405*a* may be carried by the jet into contact with the target formation.

The tracer additive 405*a* may be a solid particulate material like that of tracer additives described herein. The additive 405*a* may be packed tightly within the insert hollow 456 that the additive adheres or otherwise stays therein, thus avoiding any spillage or material loss of significance. While the additive 405*a* could be liquidous, the use of solid material means there will not be any liquid seepage. The tracer additive 405*a* may be resilient, durable, and unaffected by the otherwise extreme conditions brought by the explosive material jet.

The tracer additive 405*a* may be disposed or used in other aspects of the shaped charge 428. For example, as mentioned the tracer additive 405*a* may be blended or mixed with a liner powder in order to form a liner powder mixture. This mixture may then be press formed into the liner 438.

The tracer additive 405*a* may be used with any of the insert 452 (or packed mixture 454), the liner 438, the explosive material 440, and combinations thereof. Where and how much of the tracer additive is used 405*a* may depend upon a desired amount of tracer loading.

Figure 4D:
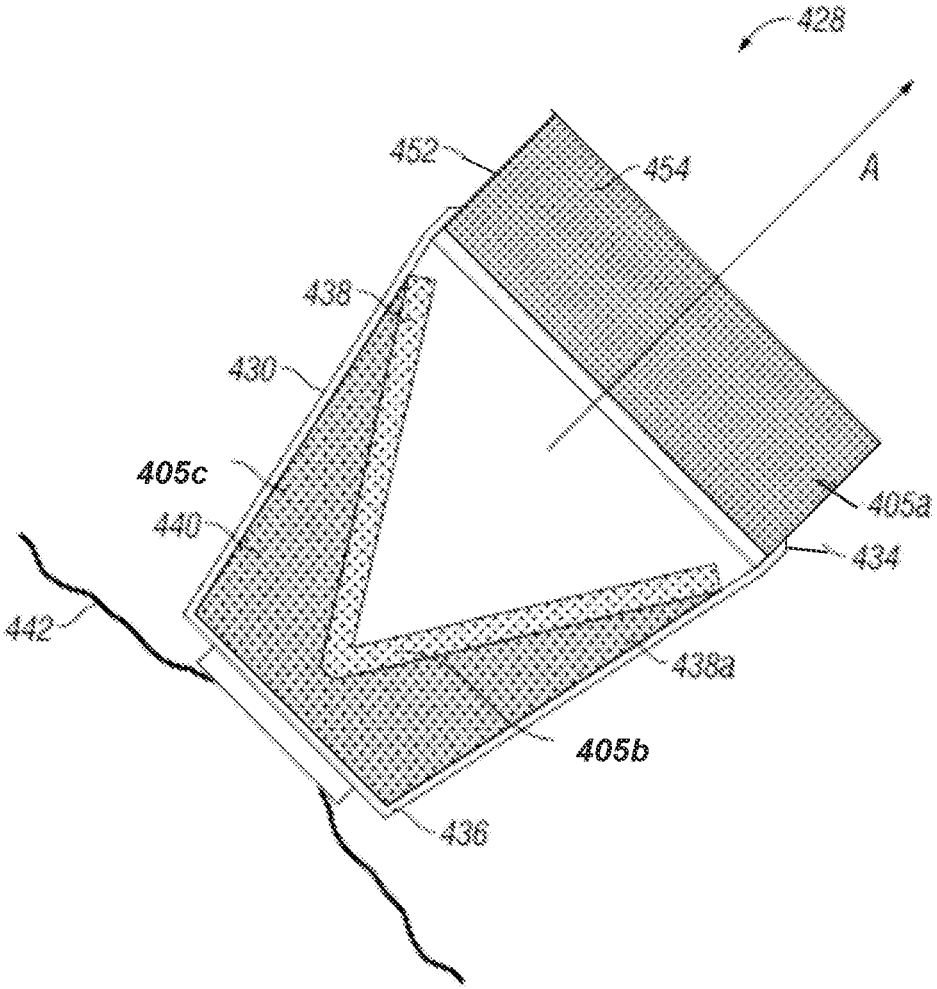
FIG. 4D shows a side cross-sectional view of a shaped charge having a plurality of tracer additives disposed therein according to embodiments of the disclosure.

Briefly, FIG. 4D illustrates how, in addition to the tracer additive 405*a*, a second tracer additive 405*b* and another or third tracer additive 405*c* may be used with the shaped charge 428. Other variations are possible without limitation.

Figure 4E:
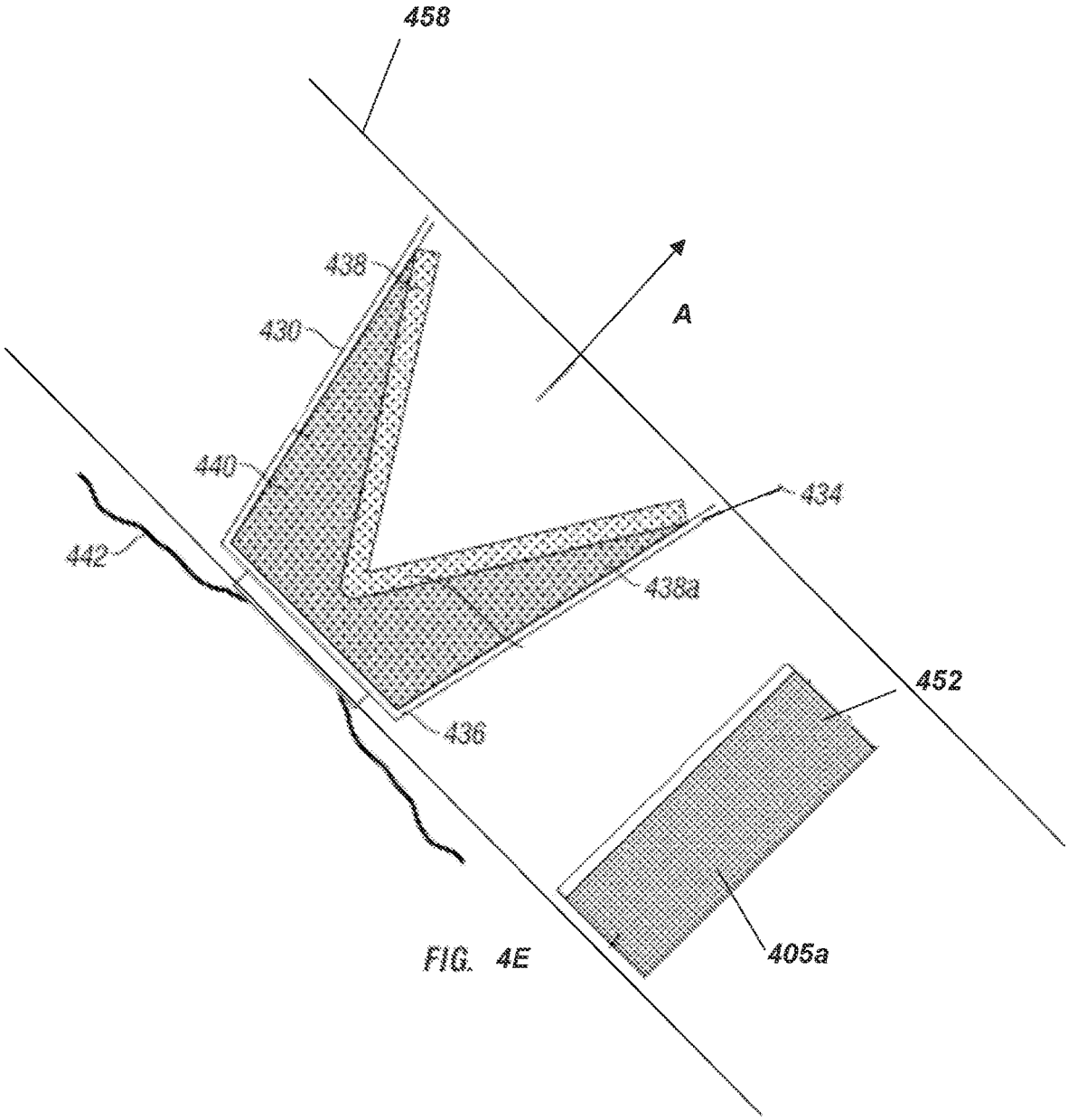
FIG. 4E shows a side cross-sectional view of a shaped charge proximate an insert according to embodiments of the disclosure.

In this respect, FIG. 4E shows the tracer additive 405*a* may be associated with the shaped charge 428 via proximate vicinity, such as adjacent or next to each other. In embodiments, the insert 452 may be placed proximately to the charge 428, such as in front of the charge 428, next to the charge 428, or on the side, etc. or any other position/location (e.g., in the charge loading tube 458—shown only in part here).

While it may not be apparent from the scale of the drawing shown here, the reality is that even when the additive 405*a* may be to the side, the explosion will still come into the contact—at least partially—with the additive 405*a*. So even in this configuration the explosive material jet stream comes into contact with the additive 405*a*. It may also be the case that additive 405*a* may be drawn into the jet stream via suction.

Returning again to FIGS. 2A-2C together, after an amount of time (which may be predetermined or otherwise known), the first tracer 205*a* may begin to disperse in or at the target formation 201*a*. With detonation, the amount of time for dispersion of the first tracer 205*a* into the formation 201*a* may be rapid or nearly instantaneous.

The first tracer 205*a* may be completely miscible with the wellbore fluids. The first tracer 205*a* may be inert in the respect that there is no effect by the first tracer 205*a* on the wellbore fluid and/or the formation 201 (or target formation 201*a*) and/or vice versa.

The tracer 205*a* (or at least a portion thereof) may have an average residence time in the target formation 201*a*. The first tracer additive 205*a* may be selected for its particular uniqueness, and thus preferably has a different tracer characteristic (fingerprint) from other tracer additives used so that fluid returned to the surface may be identified. The tracer characteristic may be the chemical identity of the tracer additive used, such as composition or specific gravity. The tracer characteristic may be distinguishable from the tracer characteristic(s) of any other tracer additives used.

FIGS. 2 and 3 illustrate whereby the first tracer 205*a* (or any respective tracer such as second tracer 205*b*) may be brought back to the surface 202 for testing. For example, after a predetermined time period, a remnant fluid 204*b* may be produced. The remnant fluid 204*b* may include, at least partially, (some of) the first tracer 205*a* and formation fluids F. A sample of the remnant fluid 204*b* may be produced on a desired frequency, such as daily. The sampling can occur during the desired frequency over a predetermined timeframe, which may be days or months (e.g., 6 months).

Once the remnant fluid 204*b* is produced from the wellbore 203, a sample 213 may be taken or extracted from sample point 212. The rest of the remnant fluid 204*b* may be transferred to a desired destination 214, which may be a tank, a pond, another well, or other suitable storage.

The sample 213 may now be tested via test unit 220. The test unit 220 may include analysis equipment 215, which may be in operable communication with computing system 218. The computing system 218 may be configured for use in using analytical data associated with use of the test equipment 215. The test equipment 215 may provide a fluorescence response-based process, such as EDXRF and XRD.

The computing system 218 may be useful to further analyze data and other information in order to provide an indication related to performance of the wellbore 203. This may pertain to, for example, the time the tracer additive was detected, the location where the tracer additive was use, the type and composition of the tracer additive detected, the amount or concentration of tracer additive detected, and/or other measurements provided by the equipment 215 and the system 218.

The computing system 218 may have Artificial intelligence (A.I.) based flow diagnostics. The computing system 218 may access input data 221, which may be related to other aspects of the formation 201, such as geological information, fractures, and the like. The computing system 218 may include programs, scripts, and/or other types of computer instructions that generate output data 222, which may be based on the input data 221. The output data 222 may include descriptions of fluid flow patterns in the formation 201, which may identify paths of fluid flow in the wellbore 203, wellbore breaches or cross-communication (such as to a proximate offset well), fracture locations, fluid flow rates, and/or other information.

As mentioned, a second (or additional) tracer additives may be used like that of the first tracer additive 205*a*, and thus have similar composition and characteristics; however, the second tracer additive may have a second composition B different from that of the first composition A. The use of a different composition B provides a unique identifier and fingerprint as compared to that of the composition A.

The second composition B may be different from the first composition A, yet the second tracer may have characteristics similar to that of the first tracer 205*a*. For example, the second tracer may be an inert solid (in powder form) having a respective average particle diameter of about 0.01 μm to about 10 μm. The second tracer may have a respective average bulk specific gravity of about 0.6 g/cm$^3$ to about 1.6 g/cm3.

As before with the first tracer 205*a*, after the predetermined time period, a remnant fluid 204*b* may be produced. The remnant fluid 204*b* may include, at least partially, (some of) the first tracer 205*a*, the second tracer, and formation fluids F. Once the remnant fluid 204*b* is produced from the wellbore 203, a sample 213 may be taken or extracted from sample point 212.

The system 200 may be modified or adjusted based on the detection of tracers released from the formation 201. For example, well system tools, and/or other subsystems may be installed, adjusted, activated, terminated, or otherwise modified based on the information provided by the tracers. Additional fractures can be formed in the formation 201, and/or other modifications can be made based on information provided by the tracers. In some embodiments, modifications of the system 200 may be selected and/or parameterized to improve production from the formation 201. For example, the modifications may improve the sweep efficiency. Modifications of well system 200 may be selected and/or parameterized by the computing system based on data analysis performed by the computing system. Other or additional tracer additives and/or deployment devices may be used as desired.

Example

Embodiments herein provide for a method of using ultra-high resolution nanoparticle tracer technology. Methods of the disclosure may provide for a tracer portfolio that integrates advanced computational methods using Artificial Intelligence (A.I.). Such use may provide accurate, actionable, near real-time performance-flow-profile data. This may allow oil and gas operators to: optimize completion strategies: achieve the best production per foot: reduce completion and fracturing cost; and/or reduce environmental footprint.

Tracer technology described herein may be based on proprietary inert submicron particles and other environmentally friendly and cost-effective additives that are used to manufacture the right composition of each tracer. This tracer technology may utilize special inert particles fingerprinting with certain atoms as special indicators that enhance the properties of each tracer. These may then detected at the sub-atomic structure level using robust capabilities of EDXRF-type spectroscopy measurements, and therefore ensuring superior accuracy for each tracer's detection and characterization from different subsurface environments.

Deployed tracers are then recovered with production flow back or produced fluids from treatment or/and adjacent wells. During the back flowing of the well, reservoir oil/gas samples are taken on a regular basis, such as for the first 10 to 40 days. The number of days may as desired, such as up to 180 days. A small amount of the sample is analyzed using appropriate methods to detect the presence and concentration of tracer compound. Samples from traced and/or offset wells may be collected on a predetermined basis (such as daily) from production flow back at the wellhead or other suitable sample point. The sample may then be tested via a fluorescence response-based process, such as EDXRF and XRD. Such analytical techniques may be used to determine the elemental composition and crystallinity of the samples.

EDXRF is designed to analyze groups of elements simultaneously to determine those elements presence in the sample and their relative concentrations—in other words, the elemental composition of the sample. Each of the elements present in a sample produces a unique set of characteristic X-rays that is a "fingerprint" for that specific element. X-rays have a very short wavelength, which corresponds to very high energy.

Due to sub-atomic accuracy of both detection methods, it is possible to precisely determine the elemental composition, crystallographic structure, and the various combinations of hyperfine interactions in the samples, which enables very accurate identification of the tracer additives on the sub-atomic or quantum level.

Laboratory analysis that may include or incorporate advanced computational methods and proprietary diagnostics capabilities for each stage or target formation provides accurate, calibrated, actionable and cost-effective production diagnostics results. This enables operators to reduce operational cost and increase the production in oil and gas wells.

Embodiments herein may produce and achieve an extensive and long-term dataset from tracer additives during production flow profile analysis at each target formation. This information may be used together with advanced computational methods using Artificial Intelligence (A.I.) coupled with artificial neural network may provide precise completion optimization workflows for oil and gas wells.

Embodiments herein pertain to a method(s) of using a tracer additive in a wellbore. The method may include one or more steps, which may vary in sequence and scope. The method may include obtaining a perforator device having an at least one shaped charge, and disposing or associating a tracer additive therewith. The perforator device may then be disposed or otherwise run into the wellbore, such as via a gun string.

Upon detonation of the shaped charge, a first tracer additive may carry and disperse into the wellbore without any detrimental effect from the explosion. The method may include at some point later returning (producing, etc.) a remnant fluid to a surface. One of skill would appreciate the surface refers to above-ground production equipment, facilities, and so forth, being common in production operations.

The method may include taking a sample of the remnant fluid, and then testing the sample in order to analyze the remnant fluid in order to provide a set of fluid data. The method may include integrating (or otherwise analyzing, comparing, etc.) the set of fluid data with other wellbore data in order to determine a parameter associated with performance of the wellbore.

The method may utilize the tracer additive having a first tracer composition. The tracer additive may be in powder (i.e., solid) form having an average particle diameter of at least 0.01 μm to no more than 10 μm. The tracer additive may have an average bulk specific gravity. For example, the average bulk specific gravity may be in a range of at least 0.6 g/cm$^3$ to no more than 1.6 g/cm3.

The method may include additional steps, such as disposing a second shaped charge having a second tracer additive associated therewith into the wellbore. The disposing step may be done in such a manner that the second shaped charge is associated with the perforating device having the first shaped charge thereon.

The second tracer additive may have a different composition from the first chemical tracer, but otherwise may also be in powder form, may have an average particle diameter of at least 0.1 μm to no more than 10 μm, and may have average bulk specific gravity of at least 0.6 g/cm$^3$ to no more than 1.6 g/cm3.

The testing the sample step may include using a fluorescence response-based analysis. In aspects, the fluorescence response-based analysis may include use of EDXRF. In aspects, the fluorescence response-based analysis many include use of XDR.

The method may include forming a liner with a tracer additive disposed therein. The method may include providing a predetermined durable material, such as a metallic material. The predetermined durable material may be in solid powder form. The tracer additive (also in solid powder form) may be mixed with the predetermined durable material to form a liner powder mixture. The method may include pressing the liner powder mixture under sufficient pressure to form the liner. The liner may be formed into a desired liner shape, such as conical or as otherwise applicable to be used with a shaped charge.

Embodiments herein may be used in manner that is decoupled from the use of a fracturing operation. As such, any tracer additive of the disclosure may be used in a wellbore (and respective string) that does not have a fluid isolation device (e.g., frac plug, bridge plug, etc.) disposed therein. The tracer additive may come into contact with the formation via detonation of the shaped charge. A remnant fluid from the perforation may have at least a portion of the tracer additive therein may be produced to the surface

ADVANTAGES

Embodiments herein may provide for a new and improved method and system related to the use of tracers in various settings associated with an earthen formation, such as an oil and gas well. Embodiments herein apply to any wells that requires perforation to connect the wellbore to formation. For example, if desired to control the production rate from certain zones, or to shut-off water at certain zones, or to pump acid at a certain rate to certain zones, use of the shaped charge described herein is a great way to achieve the objective.

For the case of mixing a tracer in the liner or the explosive powder, no added cost of making the charge, no added work in loading the gun, no added procedure or process in perforating the formation. The result may be an intelligent charge with sensors to give production information.

The "transfer" of the tracer additive into the formation may be part of a natural part of perforating process. There is no added cost in making charges, no added work in loading the gun, no added process in perforating the formation, yet generating invaluable information of where the production comes and from which perf.

The tracer may be cost-effective and inert, stable at (excessively) high temperatures, compatible with formation fluids, non-intrusive to completion design, easy to use, and quickly tested. Other advantages may include use of tracers that are of a cost-effective material, inert and lightweight, easily deployed, non-hazardous and non-radioactive, a single tracer for water and oil phases, and precise sub-atomic accuracy.

The tracer may be deployed via a shaped charge disposed on a perforator device. Thus, the tracer is not directly mixed into a pump-down stream: instead, the tracer deploys once the shaped charge detonates.

While embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge: or exemplary, procedural or other details supplementary to those set forth herein.

What is claimed is:

1. A method of using a tracer additive in a wellbore, the method comprising:

using a perforator device configured with an at least one shaped charge disposed thereon;

associating a tracer additive with the at least one shaped charge;

sending the perforator device into the wellbore in manner whereby the perforator device arrives at a target formation in communication with the wellbore;

detonating the at least one shaped charge so that the tracer additive via an explosive jet stream discharged from the shaped charge is carried into contact with the target formation;

upon contacting the target formation with the tracer additive for an amount of time, returning a remnant fluid that includes at least a portion of the tracer additive to a surface;

taking a sample of the remnant fluid;

testing the sample in order to analyze the remnant fluid in order to provide a set of fluid data; and integrating the set of fluid data with other wellbore data in order to determine a parameter associated with performance of the wellbore, wherein the testing the sample step comprises using a fluorescence response-based analysis, wherein the tracer additive has a first tracer composition, and wherein the tracer additive is in a solid powder form having an average particle diameter of at least 0.01 μm to no more than 10 μm.

2. The method of using the tracer additive of claim 1, wherein the fluorescence response-based analysis comprises EDXRF.

3. The method of using the tracer additive of claim 1, wherein the shaped charge further comprises: a shaped charge housing having a first charge housing end; a second housing end; and an inner cavity; and an explosive material disposed within the inner cavity, wherein the shaped charge is configured to detonate upon activation of a signal and form the explosive jet stream, and wherein the tracer additive is associated with the shaped charge housing in a way whereby the explosive jet stream comes into contact with the tracer additive.

4. The method of claim 1, wherein a liner is disposed in the inner cavity in a manner to maintain the explosive material therein, wherein the tracer additive is mixed with a liner material to form the liner, and wherein the tracer additive in the liner comprises no more than 10% (by weight) of the liner.

5. The method of claim 1, the shaped charge further comprising:

a liner disposed in the inner cavity in a manner to maintain the explosive material therein; and an insert coupled with the first charge housing end, wherein the tracer additive is disposed in at least one of: the explosive material, the liner, the insert, and combinations thereof.

6. The method of using the tracer additive of claim 1, wherein the shape charge further comprises a liner, and wherein at least a portion of the tracer additive is disposed in the liner.

7. A method of using a tracer additive in a wellbore, the method comprising:

using a perforator device configured with an at least one shaped charge disposed thereon;

associating a tracer additive with the at least one shaped charge;

sending the perforator device into the wellbore in manner whereby the perforator device arrives at a target formation in communication with the wellbore;

detonating the at least one shaped charge so that the tracer additive via an explosive jet stream discharged from the shaped charge is carried into contact with the target formation;

upon contacting the target formation with the tracer additive for an amount of time, returning a remnant fluid that includes at least a portion of the tracer additive to a surface;

taking a sample of the remnant fluid; and testing the sample in order to analyze the remnant fluid in order to provide a set of fluid data, wherein the testing the sample step comprises using a fluorescence response-based analysis, wherein the tracer additive has a first tracer composition, and wherein the tracer additive is in a solid powder form having an bulk average particle diameter of at least 0.01 μm to no more than 10 μm.

8. The method of using the tracer additive of claim 7, wherein the fluorescence response-based analysis comprises EDXRF.

9. The method of using the tracer additive of claim 7, wherein the shaped charge further comprises: a shaped charge housing having a first charge housing end; a second housing end; and an inner cavity; and an explosive material disposed within the inner cavity, wherein the shaped charge is configured to detonate upon activation of a signal and form the explosive jet stream, and wherein the tracer additive is associated with the shaped charge housing in a way whereby the explosive jet stream comes into contact with the tracer additive.

10. The method of claim 9, wherein a liner is disposed in the inner cavity in a manner to maintain the explosive material therein, wherein the tracer additive is mixed with a liner material to form the liner, and wherein the tracer additive in the liner comprises no more than 10% (by weight) of the liner.

11. The method of claim 7, the shaped charge further comprising:

a liner disposed in the inner cavity in a manner to maintain the explosive material therein; and an insert coupled with the first charge housing end, wherein the tracer additive is disposed in at least one of: the explosive material, the liner, the insert, and combinations thereof.

12. The method of using the tracer additive of claim 7, wherein the shape charge further comprises a liner, and wherein at least a portion of the tracer additive is disposed in the liner.

13. A method of using a tracer additive in a wellbore, the method comprising:

using a perforator device configured with an at least one shaped charge disposed thereon;

associating a tracer additive with the at least one shaped charge;

sending the perforator device into the wellbore in manner whereby the perforator device arrives at a target formation in communication with the wellbore;

detonating the at least one shaped charge so that the tracer additive via an explosive jet stream discharged from the shaped charge is carried into contact with the target formation;

upon contacting the target formation with the tracer additive for an amount of time, returning a remnant fluid that includes at least a portion of the tracer additive to a surface;

taking a sample of the remnant fluid;

testing the sample in order to analyze the remnant fluid in order to provide a set of fluid data; and integrating the set of fluid data with other wellbore data in order to determine a parameter associated with performance of the wellbore, wherein the at least one shaped charge further comprises: a liner disposed in an inner cavity in a manner to maintain the explosive material therein, wherein the tracer additive is disposed in at least one of: the explosive material, the liner, and combinations thereof, wherein the tracer additive has a first tracer composition, wherein the tracer additive is in a solid powder form having a bulk average particle diameter of at least 0.01 μm to no more than 10 μm, and wherein the testing the sample step comprises using a non-destructive energy dispersive x-ray fluorescence (EDXRF) response-based analysis.

14. The method of using the tracer additive of claim 13, wherein the tracer additive in the liner comprises no more than 10% (by weight) of the liner.

* * * * *